United States Patent [19]

Gebelius

[11] 4,440,521

[45] Apr. 3, 1984

[54] METHOD TO DISTRIBUTE WEAR FROM PASSING VEHICLES OVER A ROAD SURFACE

[76] Inventor: Sven R. V. Gebelius, Drottningholmsvägen 195, Bromma, Sweden, S-161 36

[21] Appl. No.: 354,089

[22] PCT Filed: Jun. 2, 1981

[86] PCT No.: PCT/SE81/00159

§ 371 Date: Jan. 25, 1982

§ 102(e) Date: Jan. 25, 1982

[87] PCT Pub. No.: WO81/03513

PCT Pub. Date: Dec. 10, 1981

[30] Foreign Application Priority Data

Jun. 4, 1980 [SE] Sweden ..... 8004173

[51] Int. Cl.[3] ..... E01F 9/00

[52] U.S. Cl. ..... 404/72; 404/9

[58] Field of Search ..... 404/72, 6, 75, 9, 14, 404/12, 13, 1

[56] References Cited

U.S. PATENT DOCUMENTS

| | | | |
|---|---|---|---|
| 2,260,051 | 10/1941 | Pardee | 404/12 |
| 2,287,685 | 6/1942 | Jelinek | 404/12 |
| 2,931,279 | 4/1960 | Wiswell | 404/13 |
| 3,263,578 | 8/1966 | Pilcher | 404/13 |
| 3,768,383 | 10/1973 | Tucker | 404/9 X |
| 3,936,207 | 2/1976 | Sticha | 404/14 |
| 4,245,888 | 1/1981 | Wardecki | 404/14 X |

FOREIGN PATENT DOCUMENTS 7801703-5 3/1978 Sweden .

OTHER PUBLICATIONS

"Strasse und Autobahn", No. 9, pp. 391-392, (1973).

*Primary Examiner*—James A. Leppink
*Assistant Examiner*—Beverly E. Hjorth
*Attorney, Agent, or Firm*—Holman & Stern

[57] ABSTRACT

A method to distribute wear from passing vehicles to a road surface, according to which individual marks (3, 3', 4, 4', 5, 5') are applied to the road surface of each lane (1, 1') spaced apart from each other and extending in the direction of the road. The marks are applied in a side-by-side related distance that mainly corresponds to the width of each lane (1, 1'), and located in the lanes (1, 1') in such a way, that vehicles travelling in the lanes (1, 1') and passing over the marks (3, 3', 4, 4', 5, 5') with the wheels adjacent to the marks (3, 3', 4, 4', 5, 5') maintain the normal distance between each other corresponding to vehicles travelling in the center of the lanes (1, 1'). When the marks (3, 3', 4, 4', 5, 5') are mainly removed, due to the wear from vehicles passing over the marks (3, 3', 4, 4', 5, 5'), a new set of marks (3, 3', 4, 4', 5, 5') are applied, moved slightly sideways in relation to the marks (3, 3', 4, 4', 5, 5') first applied. Said marks (3, 3', 4, 4', 5, 5') are preferably painted to the road surface in a different color to conventional road marking lines, and also preferably including a symbol, such as a device mark or similar. By repeating the above described operation, the vehicles are successively moved from one side of the road towards the other side, thus distributing the wear imposed to the road mainly over the entire road surface. Each lane, (1, 1') may also be arranged with two lines of spaced marks (3, 3', 4, 4', 5, 5') at an internal distance mainly corresponding to the wheel-base of commonly used types of vehicles, in which case the drivers try to locate the vehicles in relation to the marks (3, 3', 4, 4', 5, 5') in such a way, that all wheels pass over the applied marks (3, 3', 4, 4', 5, 5').

11 Claims, 2 Drawing Figures

METHOD TO DISTRIBUTE WEAR FROM PASSING VEHICLES OVER A ROAD SURFACE

CROSS REFERENCE TO RELATED APPLICATION

The invention of this application is disclosed in corresponding International Application No. PCT/SE81/00159 filed June 2, 1981, the benefit of which is being claimed.

BACKGROUND OF THE INVENTION

The present invention relates over a method for distributing wear from passing vehicles to a road surface.

Due to the wear imposed on a road surface from vehicles travelling along the same, mainly concave ruts are formed in each lane, spaced apart at a distance basically corresponding to the wheel-base of common types of vehicles. Such wear is often accentuated during the winter, when a large number of vehicles are fitted with studded tires, and the ruts in the road surface are particularly dangerous during spring, when melting snow and rain fill the ruts with water, since a hydroplaning might occur when a vehicle is travelling at high speed with the wheels in said ruts. The damage caused to the road surface by passing vehicles has previously been regarded as unavoidable, and road surfaces with a high traffic intensity have been re-asphalted at short intervals of time. This has resulted in high road maintenance costs, and also in reductions of the traffic volume when such work is being carried out, since certain lanes of road sections must be closed for traffic while the maintenance work takes place. Such work also involves obvious risks of accidents, involving the maintenance staff performing the necessary re-asphalting operation. Accordingly, it would be extremely desirable to distribute the wear more evenly over the road surface, partly in order to reduce the maintenance costs, but also to reduce the risk of accidents caused by hydroplaning, since such risk is increased when deep ruts exist in a road surface.

SUMMARY OF THE INVENTION

The present invention discloses a method whereby wear is more evenly distributed over a road surface, thus reducing the risk of hydroplaning, as well as prolonging the interval of time between each re-asphalting operation, thereby considerably reducing the maintenance costs. A further advantage is, that the prolonged interval of time between each maintenance operation also results in the possibility of maintaining a larger traffic volume for longer periods of time.

The method according to the present invention is mainly characterised in that marks with a predetermined configuration are painted on the road surface, spaced apart from each other and extending in the direction of the road, said marks preferably being arranged in a different color to existing road marking lines and located adjacent but in a laterally displaced relationship to existing ruts formed by passing vehicles in the road surface. Vehicles travelling along the road are directed to pass over the marks applied to the road surface by the wheel located most adjacent to the applied marks, and new marks are applied when the first applied marks have been basically worn away, the new marks being further moved in a lateral relationship to the marks first applied.

BRIEF DESCRIPTION OF THE DRAWINGS

The method according to the present invention is more fully described below, reference being made to the accompanying drawing, in which.

DETAILED DESCRIPTION OF THE INVENTION

Figure 1:
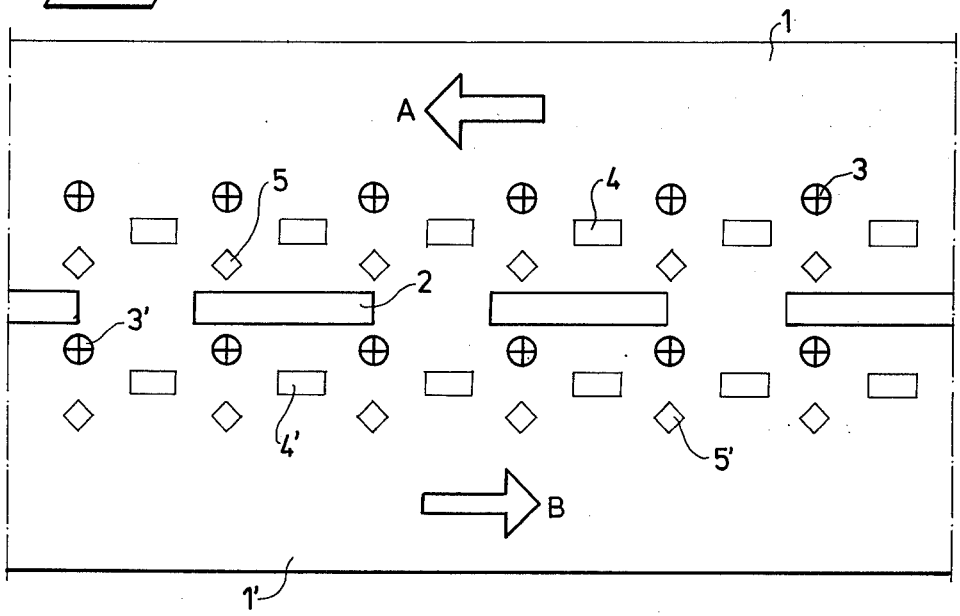
FIG. 1 shows a view from above of a road surface, having one lane for travel in each direction, arranged with marks according to a first embodiment of the present invention.

Reference numerals 1, 1' denominate two lanes in a road, intended to faciliate single lane traffic in two opposed directions. The road surface is in a previously known manner arranged with a road centre line 2, which separates the two lanes 1, 1' from each other.

The embodiment shown in FIG. 1 is a preferred embodiment, according to which a dot or line mark 3, 3' is applied in each lane, and this is assumed to the first marks applied to the road surface in each lane 1, 1'. Said first marks 3, 3' are located in such a way, that a vehicle having a a first direction of travel, denominated A, takes up a position adjacent to the outside edge of the road, when the vehicle travels in the lane 1 in such a way, that the left wheels of the vehicle pass over the marks 3. Said vehicle is thus located at a rather long distance from the centre line 2, which separates the lanes 1, 1' from each other. In the other lane 1', having a second direction of travel denominated B, the marks 3' are located more adjacently to the centre line markings 2, which causes a vehicle travelling in the second lane 1' with left wheels of the vehicle arranged to pass over the marks 3' to take up a more adjacent location to the centre line 2. Vehicles travelling in both lanes 1, 1' are thus moved sideways in relation to the centre line 2, but since they are moved in the same direction, the internal distance between the vehicles remains unchanged in comparison to two vehicles, travelling in the centre of each lane 1, 1'.

After a certain time, the marks 3, 3' are mainly removed due to the wear imposed by passing vehicles, and this period of time indicates when it would be preferable to move the traffic, in order to avoid formation of deep ruts in the road surface. Accordingly, new marks are now applied, denominated 4, 4'. This second set of marks 4, 4' are moved sideways in relation to the previously applied marks 3, 3' in such a way, that vehicles travelling in direction A now travel at a larger distance from the road side, whereas vehicles travelling in direction B now are located more adjacent to the road side in their lane 1', provided that the vehicles continue to travel in the previously disclosed fashion also with regard to the marks 4, 4'.

As previously mentioned, new marks are preferably applied in a color which is different to previously used marks, but there are also other methods to accomplish distinction between new and earlier marks, such as by arranging the marks with a different configuration, e.g. as symbols. Combinations of different colors and symbols may also be used in order to emphasize the difference between earlier and later applied marks, e.g. by utilizing a certain color for spring, a different color for summer, or in any other desired fashion.

A third set of marks, denominated 5, 5', are also shown in FIG. 1, intended to be applied when the second set of marks 4, 4' have been removed by wear. Said third set of marks 5, 5' are further moved in relation to the first set of marks 3, 3', whereby vehicles travelling in direction A now are located adjacent to the centre line 2, whereas vehicles travelling in direction B are located at a rather large distance from said centre line 2.

Figure 2:
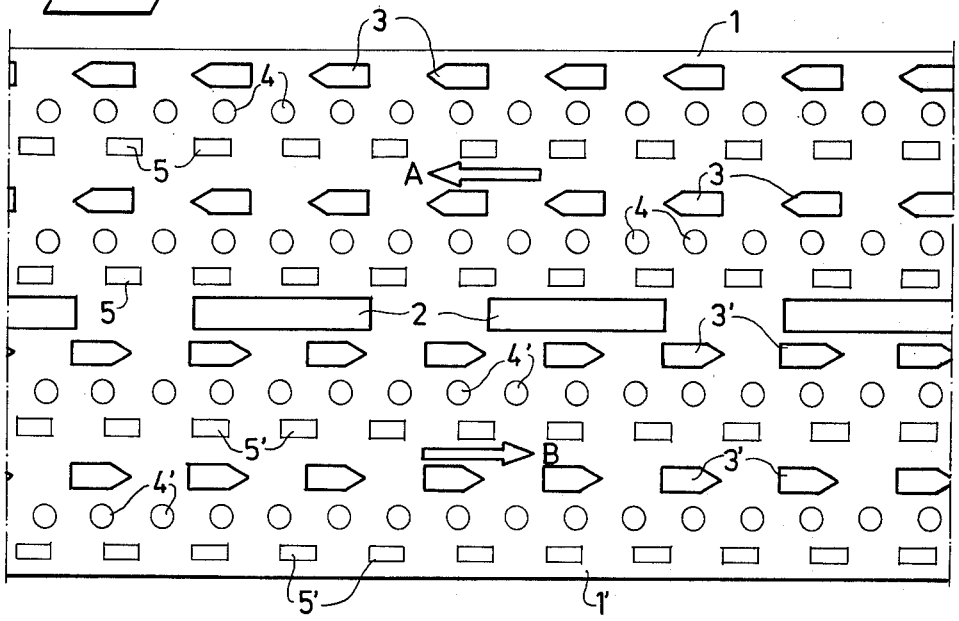
FIG. 2 shows a view of a road corresponding to FIG. 1 having marks applied according to a second embodiment of the present invention.

FIG. 2 relates to a second embodiment, according to which marks 3, 3', 4, 4', 5, 5' are painted in a manner according to the embodiment disclosed with reference to FIG. 1, but instead of painting only one line of spaced marks 3, 3', 4, 4', 5, 5' in each lane 1, 1', two lines of marks are painted in each lane 1, 1', spaced apart from each other at a distannce mainly corresponding to the wheel-base of the type of vehicles most commonly used. The drivers of the vehicles are in this case instructed to attempt to pass over the marks 3, 3', 4, 4', 5, 5' with all wheels of the vehicle, and the marks 3, 3', 4, 4', 5, 5' are applied to the road surface successively, i.e. the marks 3, 3' are first applied, and when these are mainly worn off, marks 4, 4' are applied, and finally, marks designated 5, 5' are applied.

Obviously, the method according to the present invention can only be utilized provided that an information campaign is used to inform the drivers of the object of the marks, and how these are intended to reduce the wear on the road surface and the risk for accidents due to hydroplaning. Even if only 50–70% of the drivers follow these instructions, a considerably longer interval of time will elapse between the maintenance operations, since obviously even such low percentage figures considerably distribute the wear imposed to the road surface.

The possibility of varying the marks applied to the road surface, e.g. by using symbols in different shape and/or color, also makes it possible to apply new marks at certain intervals of time, by using a uniform symbol/color for a certain geographical area. The marks may consist of symbols including letters, numerals, or devices and may be applied by painting the road, preferably using a paint with fluorescent or reflective properties.

Furthermore, the marks applied can obviously have a configuration resembling certain company trademarks or marks advertising certain clubs or associations, and this would make it possible for road maintenance departments to charge parties interested in using the road surface for advertising purposes, and such charges would cover the costs for applying the marks to the road surface.

The method according to the present invention can thus be varied in a number of ways, and the described embodiments only serve as examples of embodiments within the scope of the inventive thought and the following claims.

I claim:

1. A method of evenly distributing the wear from passing vehicles over the surface of a road comprising:

applying to the surface of each lane of traffic of said road a first plurality of linearly spaced first marks extending in the direction of traffic flow;

directing vehicles using said lane so that all wheels on a given side of every vehicle pass over said first marks, and when said first marks are substantially worn off;

applying to the surface of each lane of traffic of said road a second plurality of linearly spaced second marks extending in the direction of traffic flow, the line of said second marks being laterally displaced in relation to said first marks; and directing vehicles using said lane so that all wheels on the given side of every vehicle pass over said second marks.

2. The method of claim 1 wherein when said second marks are substantially worn off;

applying to the surface of each lane of traffic of said road a third plurality of linearly spaced third marks extending in the direction of traffic flow, the line of said third marks being laterally displaced in relation to said first marks and second marks; and directing vehicles using said lane so that all wheels on the given side of every vehicle pass over said third marks.

3. The method of claim 1 or 2 where the road has more than one lane, where all lanes travel in the same direction, and wherein each plurality of the same said marks is applied to each lane at substantially the same distance from the left-hand boundary of each lane, the distance being different for each different plurality of marks, so that traffic in different lanes is properly spaced apart.

4. The method of claim 3 wherein two identical plurality sets of each mark are applied in each lane about an average wheel base apart and wherein vehicles using each lane are directed so that wheels on the left side of every vehicle pass approximately over one identical set and wheels on the right side of every vehicle pass approximately over the other identical set.

5. The method of claim 3 wherein each of said pluralities of marks is different from the other as to configuration, color, or both.

6. The method of claim 1 or 2 where the road has more than one lane, where at least one lane travels in a first direction and at least one lane travels in the opposite direction, and wherein in the first direction each plurality of the same said marks is applied to each lane at substantially a first same distance from the left-hand boundary of each first direction lane, the distance being different for each different plurality of marks, and wherein in the opposite direction each plurality of the same said marks is applied to each lane at substantially a second same distance from the left-hand boundary of each opposite direction lane, the distance being different for each different plurality of marks, and wherein each plurality of the same marks in adjacent lanes travelling in opposite directions is applied a distance apart about equal to the normal distance between cars travelling in adjacent lanes, and the distances in the remaining lanes are measured therefrom, so that traffic in different lanes is properly spaced apart.

7. The method of claim 6 wherein two identical plurality sets of each mark are applied in each lane about an average wheel base apart and wherein vehicles using each lane are directed so that wheels on the left side of every vehicle pass approximately over one identical set and wheels on the right side of every vehicle pass approximately over the other identical set.

8. The method of claim 6 wherein each of said pluralities of marks is different from the other as to configuration, color, or both.

9. The method of claim 1 or 2 wherein two identical plurality sets of each mark are applied in each lane about an average wheel base apart and wherein vehicles using each lane are directed so that wheels on the left side of every vehicle pass approximately over one identical set and wheels on the right side of every vehicle pass approximately over the other identical set.

10. The method of claim 1 or 2 wherein each of said pluralities of marks is different from the other as to configuration, color, or both.

11. The method of claim 10 wherein each of said pluralities of marks is comprised of painted marks having fluorescent or reflective properties.

* * * * *